US010967217B2

(12) United States Patent
Arroyo

(10) Patent No.: US 10,967,217 B2
(45) Date of Patent: Apr. 6, 2021

(54) EXERCISE POWER RACK ASSEMBLY ATTACHMENT

(71) Applicant: Peter Arroyo, Naperville, IL (US)

(72) Inventor: Peter Arroyo, Naperville, IL (US)

( * ) Notice: Subject to any disclaimer, the term of this patent is extended or adjusted under 35 U.S.C. 154(b) by 0 days.

(21) Appl. No.: 16/101,499

(22) Filed: Aug. 12, 2018

(65) Prior Publication Data

US 2020/0179744 A1 Jun. 11, 2020

(51) Int. Cl.
*A63B 21/078* (2006.01)
*A63B 21/062* (2006.01)
*A63B 21/072* (2006.01)

(52) U.S. Cl.
CPC ..... *A63B 21/078* (2013.01); *A63B 21/0626* (2015.10); *A63B 21/0724* (2013.01)

(58) Field of Classification Search
CPC ..... A63B 21/078; A63B 21/0626; A63B 21/0724; A63B 21/04–0442; A63B 21/062–08; A63B 23/12–14
See application file for complete search history.

(56) References Cited

U.S. PATENT DOCUMENTS 4,286,782 A * 9/1981 Fuhrhop ..... A63B 21/078 482/103
4,564,194 A * 1/1986 Dawson ..... A63B 21/154 482/102
5,141,480 A * 8/1992 Lennox ..... A63B 21/078 482/104
5,281,193 A * 1/1994 Colbo, Jr. ..... A63B 21/078 482/104
5,570,957 A * 11/1996 Kuly ..... A63B 23/00 384/42
D444,827 S * 7/2001 Mobley ..... A63B 21/0783 D21/694
8,337,370 B2 * 12/2012 Rogers ..... A63B 71/0036 482/104
8,491,449 B2 * 7/2013 Rogers ..... A63B 21/0615 482/100
8,657,726 B2 * 2/2014 Rogers ..... A63B 21/0615 482/100
8,876,672 B2 * 11/2014 Schiano ..... A63B 21/078 482/104
9,216,314 B2 * 12/2015 Chen ..... A63B 21/16
9,289,638 B2 * 3/2016 Towley, III ..... A63B 21/00047
9,610,490 B2 * 4/2017 Tambornino ..... A63B 71/0036
10,058,728 B2 * 8/2018 Kelly ..... A63B 21/16
10,422,473 B2 * 9/2019 Inouye ..... A63B 17/04
10,576,322 B2 * 3/2020 Schlegel ..... A63B 23/047
D890,273 S * 7/2020 Dunahay ..... D21/694
2006/0035765 A1 * 2/2006 Smith ..... A63B 21/078 482/94
2007/0049472 A1 * 3/2007 Hummer, Jr. ..... A63B 71/0036 482/104

(Continued)

*Primary Examiner* — Andrew S Lo
(74) *Attorney, Agent, or Firm* — Skokos Law Group, LLC; Soula Skokos

(57) ABSTRACT

A power rack assembly attachment having at least one support member that removably attaches to a vertical post in a power rack assembly or similar exercise equipment or machine and is connected to a parallel vertical support post that can receive a support hook for barbells. The power rack assembly attachment provides the ability to extend vertical support for support hooks closer to the user than the standard vertical posts in a power rack assembly.

5 Claims, 6 Drawing Sheets

(56) References Cited

U.S. PATENT DOCUMENTS

| | | | | |
|---|---|---|---|---|
| 2014/0200117 | A1* | 7/2014 | Grider | A63B 17/04 482/104 |
| 2015/0065316 | A1* | 3/2015 | Towley, III | A63B 21/00047 482/104 |
| 2015/0083681 | A1* | 3/2015 | Childs | A63B 21/078 211/85.7 |
| 2015/0224358 | A1* | 8/2015 | Chen | A63B 21/16 248/327 |
| 2015/0290488 | A1* | 10/2015 | Hopperstad | A63B 23/0405 482/38 |
| 2017/0007877 | A1* | 1/2017 | Leipheimer | A63B 21/078 |
| 2017/0100624 | A1* | 4/2017 | Young | A63B 21/078 |
| 2017/0246496 | A1* | 8/2017 | Nelson | A63B 21/0783 |
| 2018/0056108 | A1* | 3/2018 | Kelly | A63B 21/078 |
| 2018/0243597 | A1* | 8/2018 | Schlegel | A63B 23/047 |
| 2018/0290003 | A1* | 10/2018 | Hopperstad | A63B 21/078 |
| 2019/0099636 | A1* | 4/2019 | Schmidt | A63B 21/078 |
| 2019/0247701 | A1* | 8/2019 | Sergakis | A63B 71/0054 |
| 2019/0275363 | A1* | 9/2019 | Jones | A63B 23/03508 |
| 2019/0282846 | A1* | 9/2019 | Young | A63B 17/04 |

* cited by examiner

EXERCISE POWER RACK ASSEMBLY ATTACHMENT

FIELD OF THE INVENTION

This invention relates in general to exercise equipment and more specifically an attachment for exercise power racks and other similar exercise equipment.

SUMMARY OF THE INVENTION

The primary object of the present invention is to provide a device to assist individuals who lift weights using a power rack assembly and other similar exercise equipment. The present invention allows an individual to create additional support members to a power rack assembly and other similar exercise equipment in order provide vertical column support that is internal to the power rack assembly's existing vertical column support.

Power rack assemblies are commonly comprised of vertical columns having a rectangular frame made of steel comprised of pairs of front and rear vertical uprights or corner posts, usually also rectangular, connected together at their upper and lower ends to form a rigid open frame. Each vertical post has spaced apart and aligned apertures or through-holes into which horizontal spotter arms or barbell support hooks may be adjustably secured. To utilize the power rack assembly, support hooks are inserted into the apertures of the vertical posts at a height that would be just below the shoulders of a user. The user then places a barbell to be supported by the support hooks and position the barbell across the user's shoulders. The user then places each of his or her hands to be at a comfortable position along the length of the barbell and then lift the barbell off of the support hooks.

Certain lifters require the support hooks to be in a position closer to their body in order to provide a more comfortable position for their hands along the length of the barbell. Further, such positioning of the support hooks provides a more effective positioning of a user's hands for certain users, specifically for users who have a wide shoulder width.

The present invention discloses a power rack assembly attachment comprising a vertical support for use with a power rack assembly post and a parallel support member that receive and support barbell support hooks. Although the attachment may be used with a power rack assembly, it may be used with any similar exercise equipment.

It is an object of the invention to provide such an apparatus which can be attached to the vertical post of a power rack assembly.

It is another object of the present invention to provide a stable support for the barbell hooks and weight of a barbell.

DESCRIPTION OF THE INVENTION

The present invention is comprised of at least one support member that removably attaches to a vertical post in a power rack assembly or similar exercise equipment or machine and is connected to a parallel vertical support post that can receive a support hook for barbells. The present invention provides the ability to extend vertical support for support hooks closer to the user than the standard vertical posts in a power rack assembly.

Figure 1:
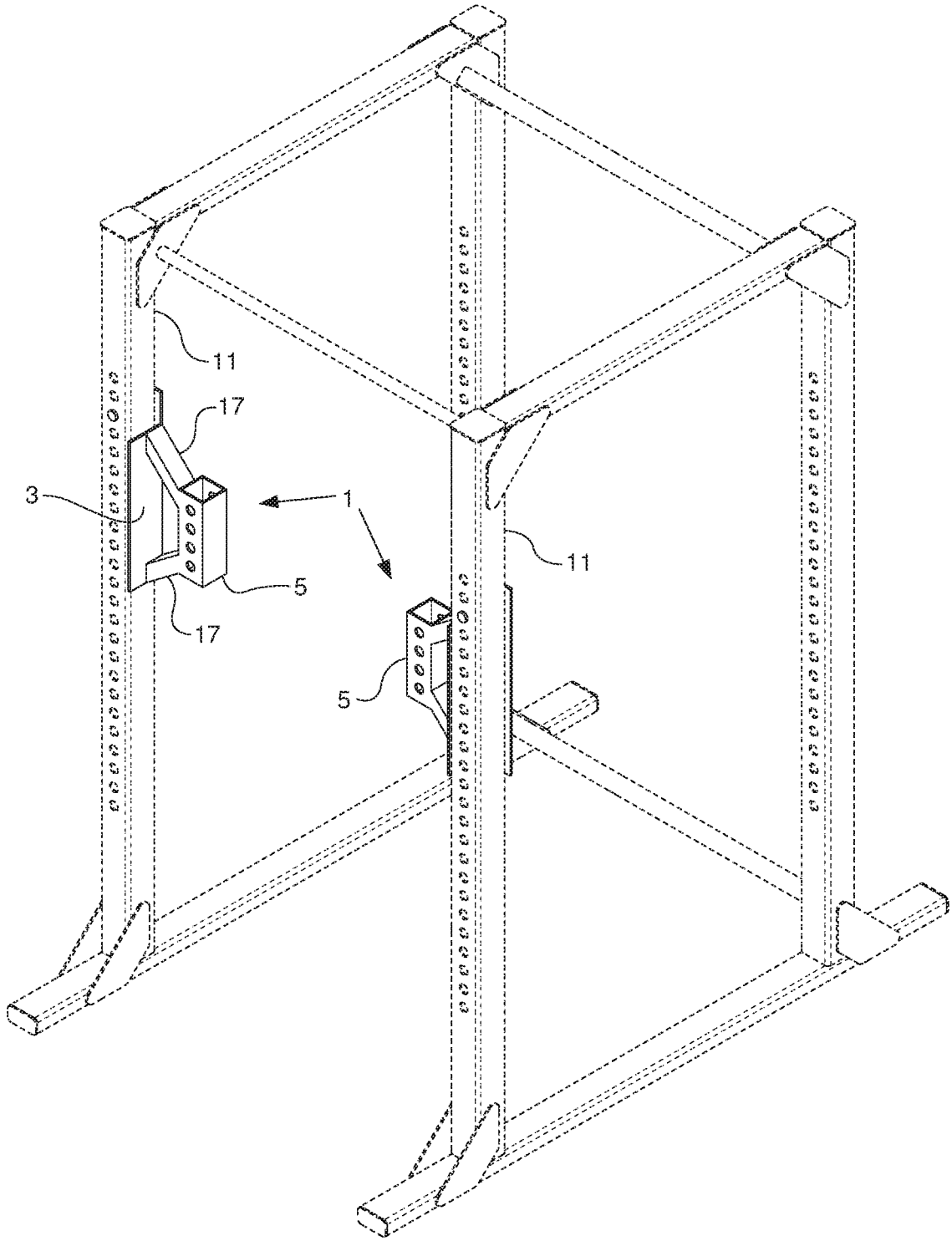
FIG. 1 is a perspective view showing a power rack assembly in broken lines wherein the present invention has been removably attached to two vertical posts of the power rack assembly.
Figure 2:
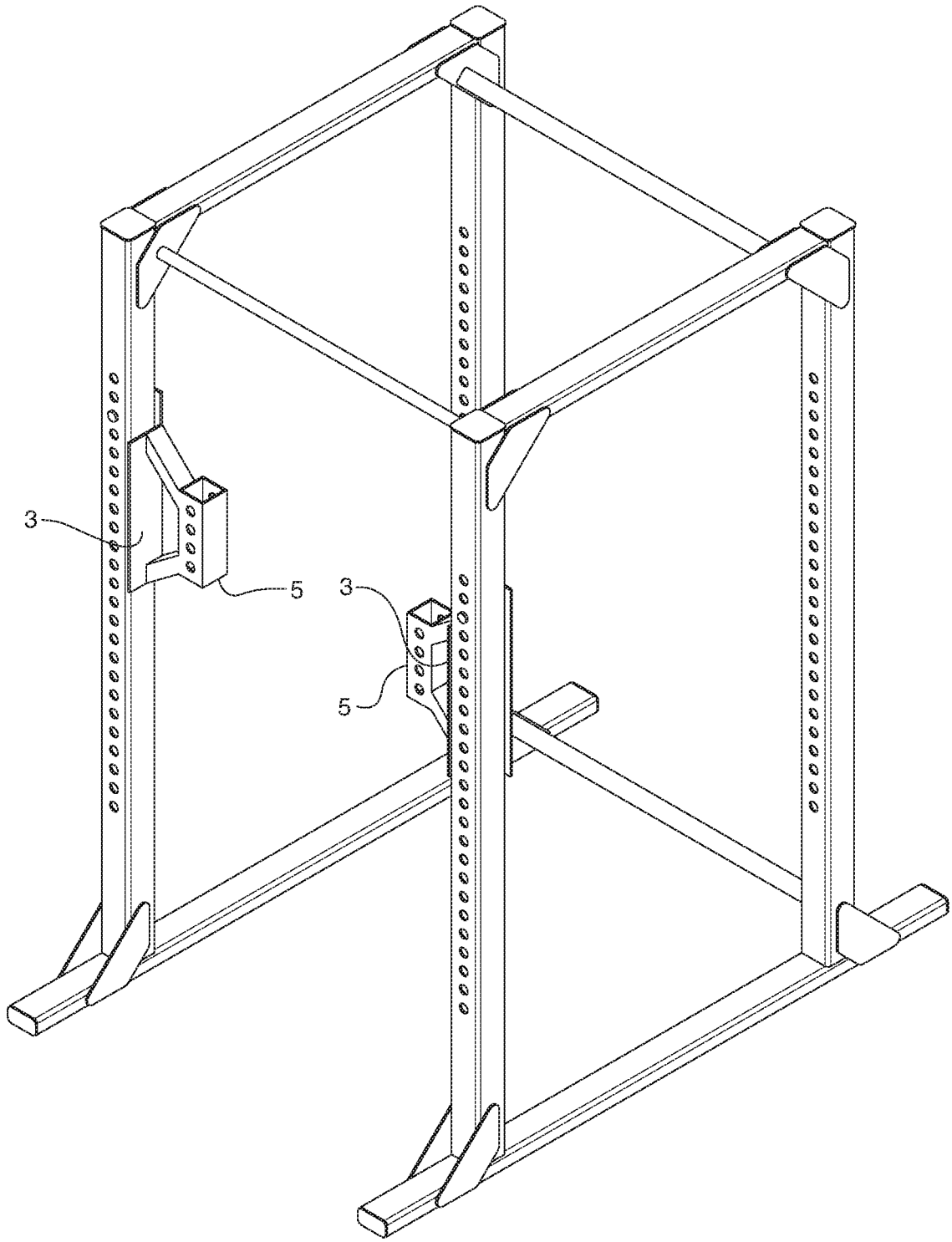
FIG. 2 is a perspective view showing a power rack assembly wherein the present invention has been removably attached to two vertical posts of the power rack assembly.
Figure 4:
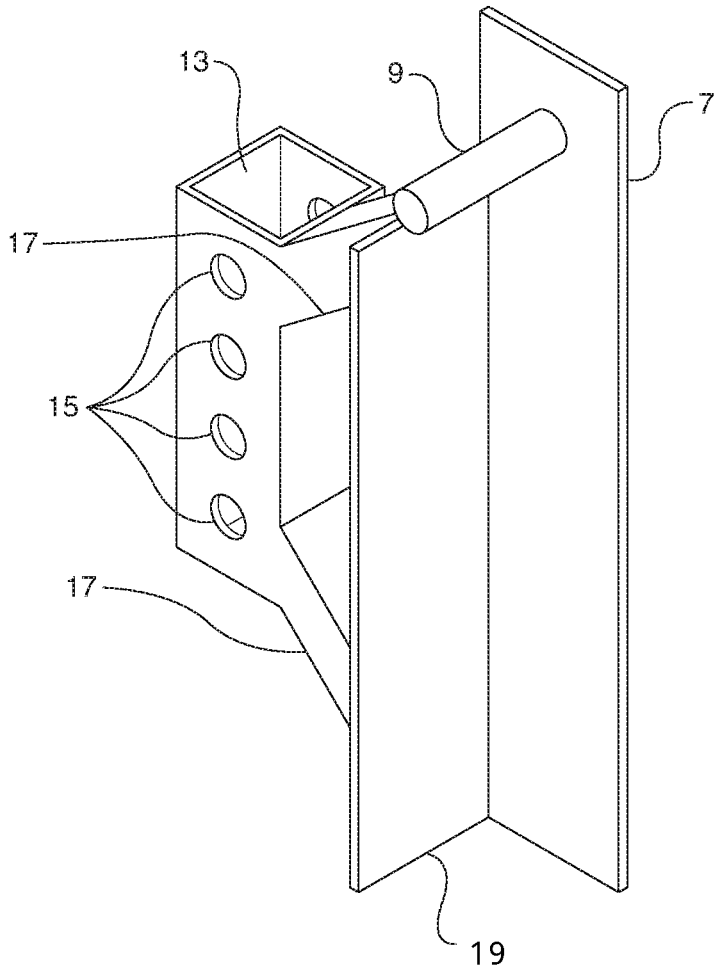
FIG. 4 is a perspective view showing the present invention.
Figure 5:
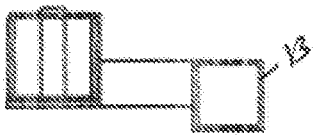
FIG. 5 is a top view showing the present invention.
Figure 6:
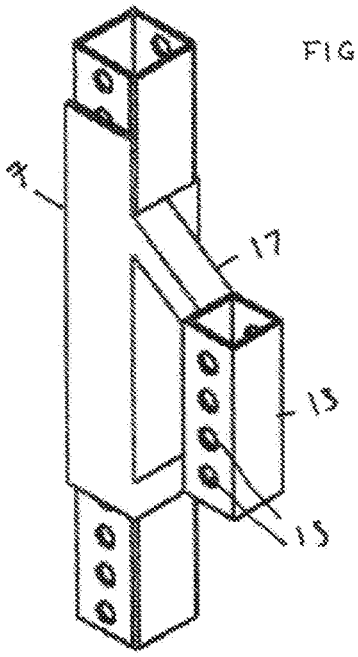
FIG. 6 is a perspective view showing the present invention.
Figure 7:
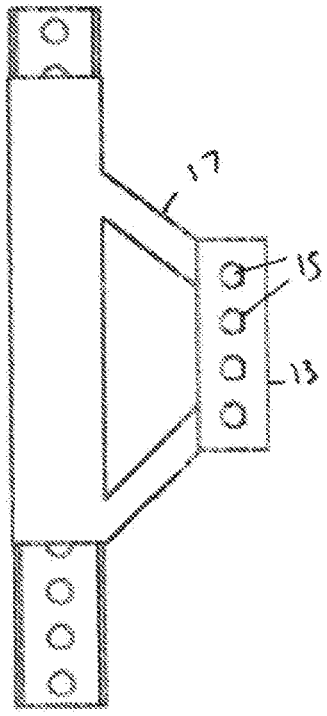
FIG. 7 is a front view showing the present invention.
Figure 8:
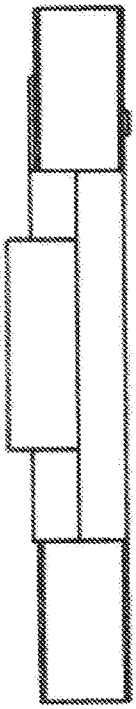
FIG. 8 is a back view showing the present invention.
Figure 9:
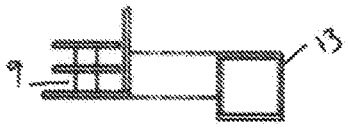
FIG. 9 is a bottom view showing an embodiment of the present invention.
Figure 10:
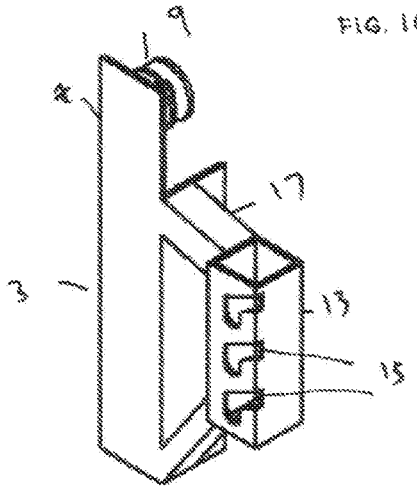
FIG. 10 is a perspective view showing an embodiment of the present invention.
Figure 11:
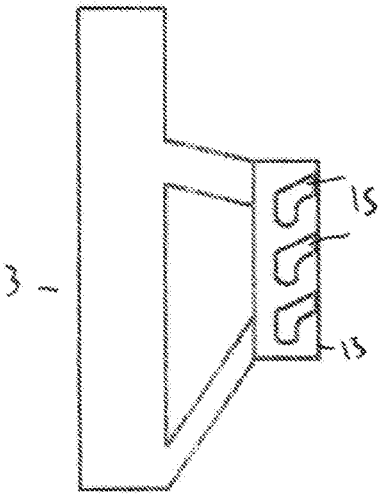
FIG. 11 is a side view showing an embodiment of the present invention.
Figure 12:
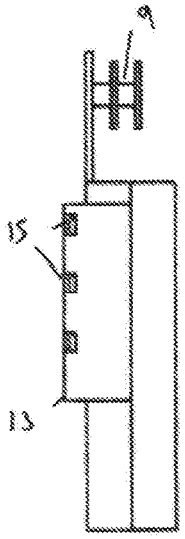
FIG. 12 is a front view showing an embodiment of the present invention.

As shown in FIGS. 1 and 2, the present invention shown generally at 1, the at least one support member 3 is comprised of at least two vertical members or plates that meet at a 90 degree angle to form a right angle. The vertical plate 7 that is most distal to the parallel vertical support post 5 further possesses a cylindrical post 9 that corresponds in size to the aperture in the vertical posts in a power rack assembly. Such cylindrical post 9 fits through such aperture in a vertical post of a power rack assembly to allow the at least one support member 3 to be removably connected to the vertical posts of the power rack assembly as shown in FIGS. 1 and 2. As shown in FIGS. 4, 6 and 8, the cylindrical post 9 may be located near the top of the vertical plate 7. The cylindrical post 9, however, may be located at any point along the length of the vertical plate 7.

Figure 3:
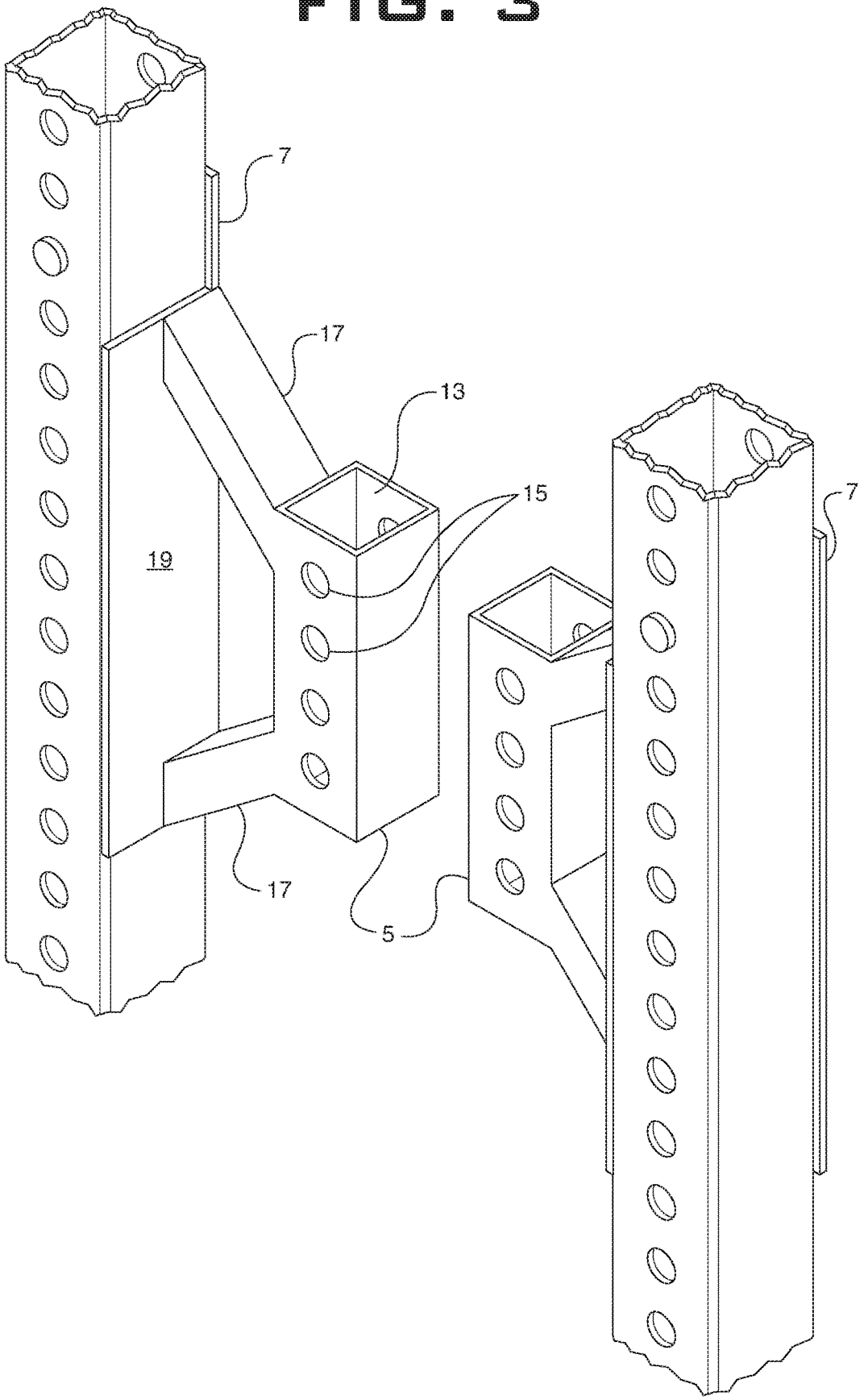
FIG. 3 is a perspective view showing a section of two vertical posts of a power rack assembly wherein the present invention has been removably attached to such sections of the two vertical posts.

As shown in FIGS. 3 and 4, the vertical plate 7 with the cylindrical post 9 is attached to the back surface 11 of a vertical post of the power rack assembly such that the cylindrical post 9 is fitted into an aperture of the vertical post. In another embodiment, the vertical plate with the cylindrical post is attached to the front surface of a vertical post of the power rack assembly.

FIGS. 4 and 6 illustrate that the at least one support member 3 is connected to a parallel vertical support post 5 that can receive a support hook for barbells. The parallel vertical support 5 is comprised of a rigid rectilinear hollow structure 13 having equally spaced apart and aligned apertures 15 or through-holes into which barbell support hooks may be adjustably secured. As shown in FIGS. 1, 2, 3, 4, 6 and 7, the at least one support member 3 and parallel vertical support 5 are connected via at least one angled rigid segments 17. The angle rigid segments are connected to the vertical plate 19 that is most proximal to the parallel vertical support 5. The at least one support member 3 and parallel vertical support 5 may be connected via any rigid connector that provides adequate support.

In a preferred embodiment, the present invention is constructed of steel or another metal having adequate strength to withstand the weight of the barbells and weights.

In another embodiment, as shown in FIGS. 9-12, the present invention is comprised of the at least one support member 3 comprised of at least two vertical member or plates that meet at a 90 degree angle to form a right angle. The vertical plate 7 that is most distal to the parallel vertical support post 5 further possesses a cylindrical post 9 that further possesses at least one circular plate at the distal end of the cylindrical post 9. Such at least one plate and cylindrical post 9 fits or pops into place in an aperture in a vertical post of a power rack assembly or similar exercise equipment to allow the at least one support member 3 to be removably connected to the vertical posts of the power rack assembly. In such embodiment, the parallel vertical support 5 is comprised of a rigid rectilinear hollow structure 13 having equally spaced apart and aligned slits 15 or slots into which barbell support hooks may be adjustably secured.

The foregoing detailed description is given for clearness of understanding only, and no unnecessary limitations should be understood therefrom, as modifications will be obvious to those skilled in the art.

I hereby claim:

1. An exercise equipment attachment comprised of at least one support member that removably attaches to a vertical post in an exercise equipment wherein said at least one support member is fixed to a parallel vertical support member possessing equally spaced apart and aligned apertures that can receive a support hook for barbells wherein the at least one support member is comprised of at least two vertical members that meet at a 90 degree angle to form a right angle and wherein one vertical member possesses a first solid surface having a cylindrical post extending from the first solid surface and a second solid surface oriented facing away from the cylindrical post wherein the cylindrical post corresponds in size to fit within an aperture in the vertical post in a power rack assembly.

2. An exercise equipment attachment according to claim 1 wherein the cylindrical post possesses at least one circular plate at one end of the cylindrical post that corresponds in size to fit within an aperture in the vertical post in a power rack assembly.

3. An exercise equipment attachment according to claim 1 wherein the parallel vertical support member is comprised of a rigid rectilinear hollow structure.

4. An exercise equipment attachment according to claim 3 wherein the parallel vertical support member possesses equally spaced apart and aligned apertures into which barbell support hooks may be adjustably secured.

5. An exercise equipment attachment according to claim 3 wherein the parallel vertical support member possesses equally spaced apart and aligned slots into which barbell support hooks may be adjustably secured.

* * * * *